US006169351B1

(12) United States Patent
Bohart et al.

(10) Patent No.: US 6,169,351 B1
(45) **Date of Patent: *Jan. 2, 2001**

(54) BRUSH ASSEMBLY FOR DYNAMOELECTRIC MACHINE

(75) Inventors: Russell J. Bohart, Baltimore; Dale K. Wheeler, Fallston, both of MD (US)

(73) Assignee: Black & Decker Inc., Newark, DE (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/891,179

(22) Filed: Jul. 10, 1997

(51) Int. Cl.[7] ..... H01R 39/38; H01R 39/40; H01R 39/36

(52) U.S. Cl. ..... 310/239; 310/242; 310/245; 310/246; 310/249

(58) Field of Search ..... 310/239, 246, 310/240, 242, 245, 251, 252, 253, 244, 249

(56) References Cited

U.S. PATENT DOCUMENTS

| | | | | |
|---|---|---|---|---|
| 1,307,028 | * | 6/1919 | Sweet | 310/239 |
| 2,194,620 | * | 3/1940 | Sekyra | 171/324 |
| 3,656,018 | | 4/1972 | Maher | 310/242 |
| 4,354,128 | | 10/1982 | Chew | 310/242 |
| 5,895,995 | * | 4/1999 | Soh | 310/239 |
| 5,939,812 | * | 8/1999 | Wetzel | 310/245 |
| 5,952,763 | * | 9/1999 | Bruhn | 310/238 |

FOREIGN PATENT DOCUMENTS

| | | |
|---|---|---|
| 3328683 | 2/1985 | (DE) . |
| 19523896 | 1/1997 | (DE) . |

* cited by examiner

*Primary Examiner*—Nestor Ramirez
*Assistant Examiner*—Dang Dinh Le
(74) *Attorney, Agent, or Firm*—Charles E. Yocum; John D. Del Ponti; Bruce S. Shapiro

(57) ABSTRACT

A brush assembly preferably for a universal motor comprises a tubular brush holder 13, a carbon brush 33, an arm 31 for biasing the brush and a spring 85 for biasing the arm. The brush is slidably mounted in the cavity 21 of the holder. A stop 61 is formed between the brush and the holder and has a disengaged position to permit travel of the brush partially through the inner end 25 of the holder and an engaged position to limit travel of the brush through the inner end 25 of the holder. The electrically conductive arm 31 is pivotally mounted on the support and extends through a slot 29 of the holder. A distal end 60 of the brush engages the outer end 53 of the brush and biases the brush 33 toward the inner end 25 of the cavity. The spring 85 is connected between the support 15 and the arm 31 for biasing the arm 31 into engagement with the brush 33. The arm is spaced outwardly of the end of the slot to apply a bias to the brush when the stop is in an engaged position. As a result the brush, when worn out is firmly held between the arm and the stop to reduce degradation of the arm 33 and commutator 35.

8 Claims, 5 Drawing Sheets

BRUSH ASSEMBLY FOR DYNAMOELECTRIC MACHINE

FIELD OF THE INVENTION

This invention relates to a brush assembly for a dynamoelectric machine, preferably a universal fractional horsepower motor.

BACKGROUND OF THE INVENTION

In fractional horsepower universal motors commonly used for power tools and appliances, electrical contact is made to the rotating armature coils through the engagement of carbon brushes with a rotating commutator. Electrical contact from the brush to the motor circuit may be provided through a shunt wire embedded in the brush or through a spring biased arm engaged with the brush. The brushes, which are made carbon, are softer than the commutator and are worn away. The brush is typically slidably mounted in a holder and is biased by a spring or a spring biased arm toward the commutator to maintain electrical contact as the brush wears with use of the motor. Typically, for cost and simplicity, there is no specific means to identify when the brush is worn and should be replaced. The need for replacement is typically identified by the user when the tool stops working. This method for detecting when the brushes should be replaced has led to some significant problems. The travel of the spring or arm must be limited when the brush is worn to prevent contact of the arm or spring with the commutator which would damage the commutator. In addition if a brush with a shunt wire is used, the travel of the brush must be limited to prevent engagement between the shunt wire embedded in the brush and the commutator. Use of a shunt wire thus reduces the usable length of the brush because of the presence of the wire within a portion of the brush.

Shunted brushes have other disadvantages compared to shuntless brushes including higher manufacturing cost, high operating temperature and lower reliability. The manufacturing cost is higher because of the cost of forming the brush with the shunt wire embedded. A shunted brush has a high operating temperature because the shunt wire is normally electrically insulated and is therefore not easily cooled. Heat buildup increases the resistance of the brush assembly and therefore increases electrical losses. The shunted brushes have lower reliability because the wire is subject to snagging during assembly and operation of the motor.

To extend brush life and to mitigate the other disadvantages, shuntless brushes are commonly used for some applications. However, in the development of shuntless brushes, damage to the brush has been observed as the brush reaches an end of life condition. Such problems have been found to occur particularly in high current power tool motor applications having ratings of 6 to 8 amps. Thus there is a need to develop a shuntless brush assembly that is less subject to damage at the end of life of the brush.

SUMMARY OF THE INVENTION

According to the present invention a brush assembly comprises a tubular brush holder, a carbon brush, an arm for biasing the brush and a spring for biasing the arm. The holder has a cavity extending in a first direction, defined by the sidewalls of the holder and having an inner and outer open ends. The brush is slidably mounted in the cavity of the holder. A stop is formed between the brush and the holder and has a disengaged position to permit travel of the brush partially through the inner end of the holder and an engaged position to limit travel of the brush through the inner end of the holder. The electrically conductive arm is pivotally mounted on the support and extends through a slot of the holder. A distal end of the arm engages the outer end of the brush and biases the brush toward the inner end of the cavity. The spring is connected between the support and the arm for biasing the arm into engagement with the brush.

A significant feature of the invention is that the arm is spaced outwardly of the end of the slot to apply a bias to the brush when the stop is in an engaged position. As a result the brush when worn out is firmly held between the arm and the stop. This has resulted in a reduction in degradation of the components of the brush assembly.

The stop is preferably constituted by first and second grooves formed respectively in first and second sidewalls of the brush and mating first and second ribs formed in sidewalls of the holder. The grooves extend from the inner end of the brush toward the outer end of the brush and slidably receive the ribs for guiding movement of the brush in the cavity of the holder as the brush wears. First and second end walls are formed, respectively, in the first and second grooves inwardly of the brush outer end. The stop engaged position is formed when the end walls of the grooves engage the ribs and limit travel of the brush through the inner end of the holder.

The arm is preferably connected to the support through a low friction pivot formed by a base of the arm pivotally biased against a sharp edge of a post integrally formed with the holder.

The spring provides essentially a constant bias on the brush through the travel of arm as the brush is worn. The spring preferably has one end anchored to the post, an intermediate section coiled about the post and the other end engaged with the midsection of the arm.

Other aspects and advantages of the invention will be apparent from the detailed description of the preferred embodiment, the appended claims and the accompanying drawings or may be learned by practice of the invention.

BRIEF DESCRIPTION OF THE DRAWINGS

The accompanying drawings which are incorporated in, and constitute a part of, this specification illustrate one embodiment of the invention and together with the description serve to explain the principles of the invention.

DESCRIPTION OF THE PREFERRED EMBODIMENTS

The preferred embodiment of the present invention is shown in FIGS. 1–9 and is a brush assembly 11 for fractional horsepower universal motors typically used in power tools and household appliances. The present invention will also have application to other types of motors and generators using commutators and brushes for making electrical connection to the windings of the armature.

Figure 1:
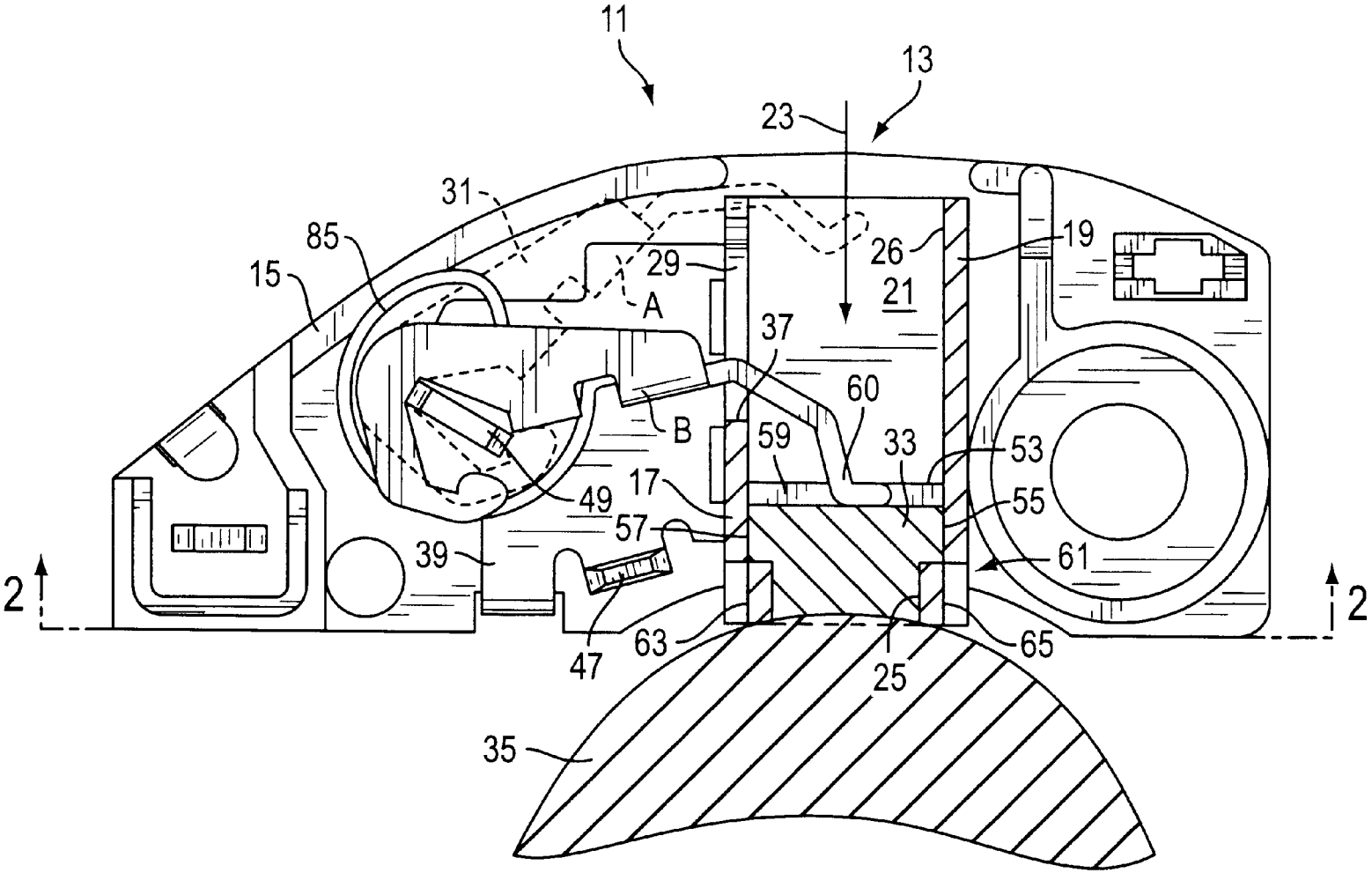
FIG. 1 is a top plan view of a brush assembly in accordance with a preferred embodiment of the present invention.
Figure 2:
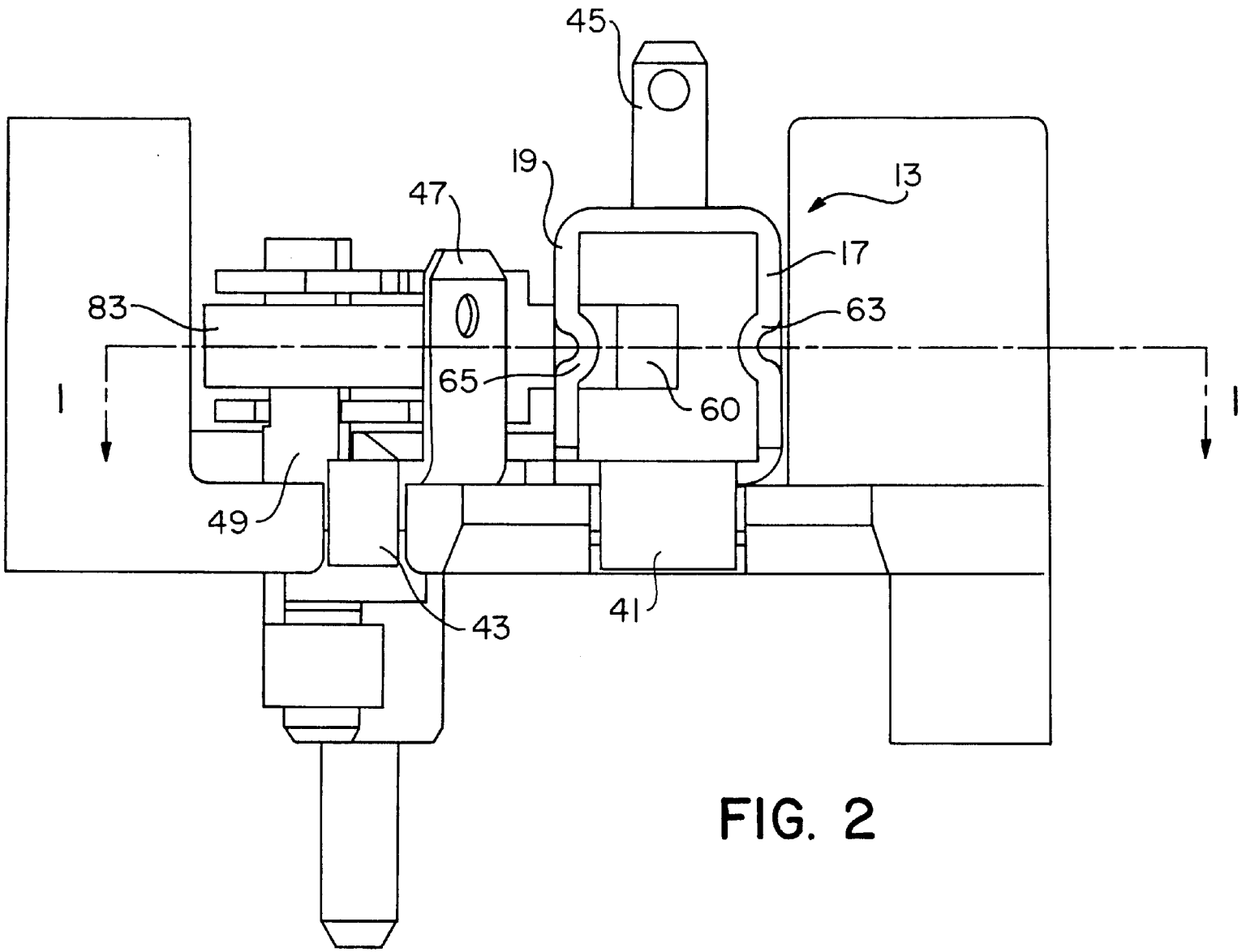
FIG. 2 is an elevational view taken along line 2—2 of FIG. 1 except that the brush has been removed from the holder.
Figure 3:
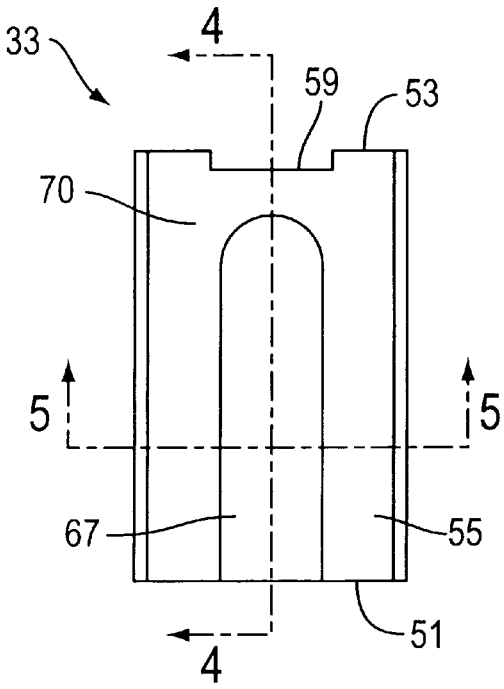
FIG. 3 is a side elevational view of a brush for use in the brush assembly shown in FIG. 1. in accordance with a preferred embodiment of the present invention.
Figure 4:
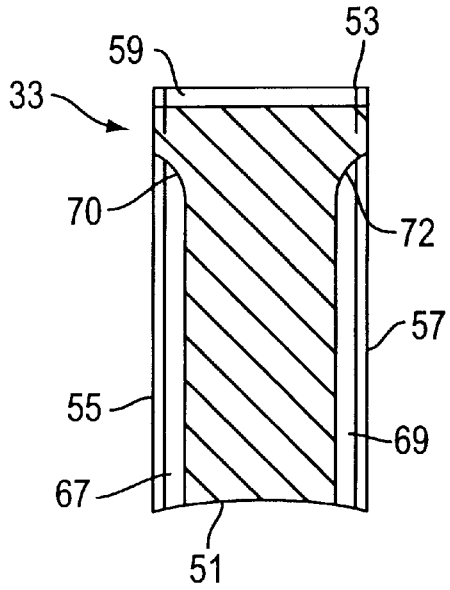
FIG. 4 is an axial cross sectional view taken along line 4—4 of FIG. 3.
Figure 5:
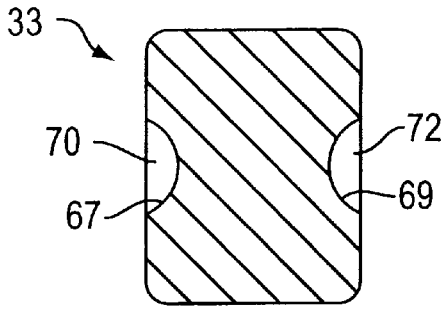
FIG. 5 is a transverse cross sectional view taken along line 5—5 of FIG. 3.
Figure 6:
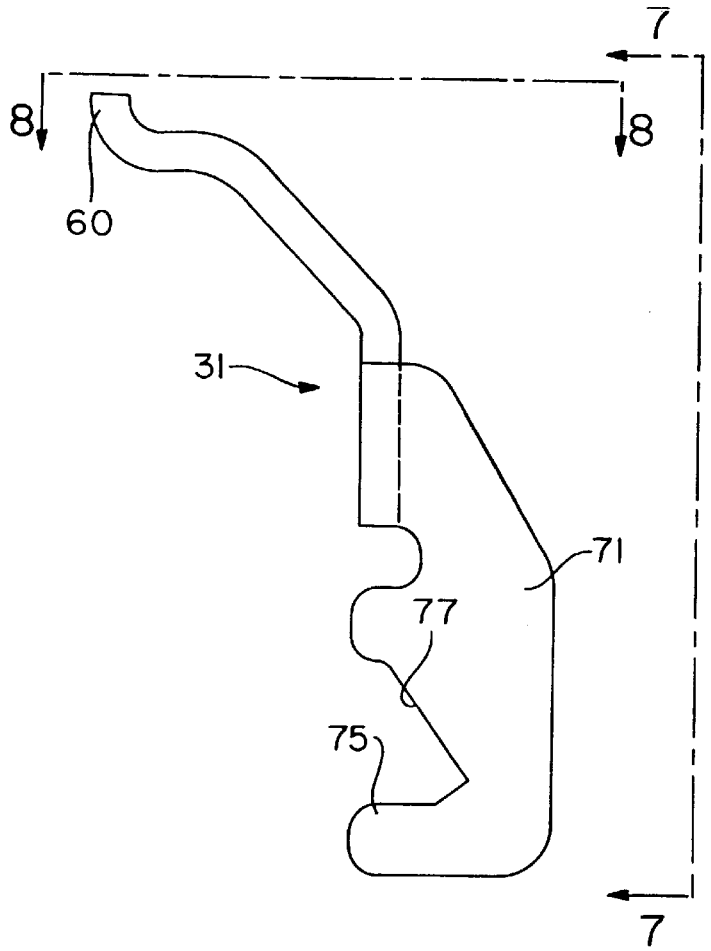
FIG. 6 is a top plan view of the arm for biasing the brush in the brush assembly of FIG. 1.
Figure 7:
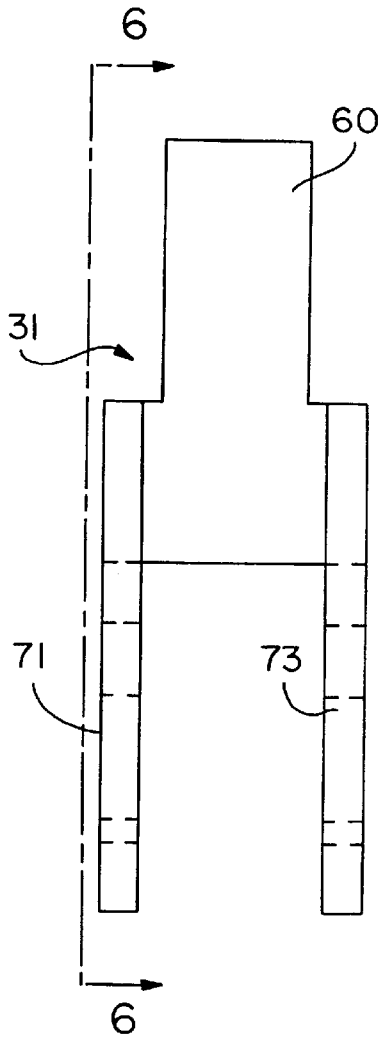
FIG. 7 is side elevational view of the arm of FIG. 1 taken along line 7—7 of FIG. 6.
Figure 8:
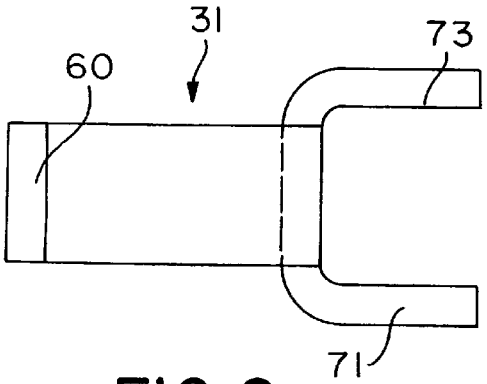
FIG. 8 is an end elevational view of the arm of FIG. 1 taken along line 8—8 of FIG. 6.

According to the present invention shown best in FIGS. 1 and 2, the brush assembly 11 comprises an electrically conductive tubular holder 13 fixed to a support. (In FIG. 2, a brush is not shown in the holder.) The support is preferably formed of electrically insulating material and is preferably fixed relative to the stator of a motor. As will be explained below, the holder 13 provides one of the primary electrical connections between a brush 33 supported in the holder 13 and the motor stator (not shown). The holder 13 includes first and second sidewalls 17, 19. A cavity 21 extends in a first direction, is defined by the sidewalls 17, 19 of the holder 13 and has an inner open end and an outer open ends 25. A slot 29 is formed in the first sidewall of the holder 13 for receiving an arm 31 for biasing the brush 33 toward a commutator 35 of the motor. The slot 29 preferably has an inner end wall 37 which, except for the present invention as explained below, would normally engage the arm 31 and limit travel of the arm 31 toward the commutator 35 of the motor.

Preferably, the holder 13 is formed from a single brass plate 39 fixed to the support by a plurality of tabs 41, 43 (two of which are shown in FIG. 2). A first terminal 45 for connecting the holder 13 to the motor stator is formed in the plate 39 and extends perpendicular to the plane of support. A second terminal 47 (FIGS. 1, 2) for connection of brush shunt wire in an embodiment of the invention (not shown) using a shunted brush. This embodiment of the invention is desirable for motors in which increased suppression of EMI is required. A post 49 is also formed integrally with the plate 39 to form a conductive pivot for the electrically conductive arm 31 for biasing the brush 33 into engagement with the commutator 35 as will be explained below.

According to the present invention as shown in FIGS. 1 and 3–5, the assembly 11 further comprises the brush 33 consisting essentially of carbon. The brush 33 is formed of a conventional composition of carbon particles with appropriate binder. The brush 33 is slidably mounted in the cavity 21 of the holder 13 and has inner and outer ends 51, 53 and first and second opposed sidewalls 55, 57 extending between the inner and outer ends 51, 53. Preferably, the brush 33 has a generally rectangular parallelepiped configuration with a transverse channel 59 in the outer end wall 53 for receiving a distal end 60 of the arm 31. A secondary current path between the motor stator and the commutator 35 is through the engagement of the brush 33 with the sidewalls 17, 19 of the holder 13. As noted above the holder 13 is connected to the motor stator through the first terminal 45.

According to the present invention as shown in FIGS. 1 and 3–5, the assembly 11 further comprises a stop 61 formed between the brush 33 and the holder 13. The stop 61 has a disengaged position to permit travel of the brush 33 partially through the inner end 25 of the holder 13 and has an engaged position to limit travel of the brush 33 through the inner end 25 of the holder 13. Preferably, the stop 61 is formed by a first and second ribs 63, 65 and first and second mating grooves 67, 69. The first and second ribs 63, 65 are arcuate, extend axially and are formed in and projecting inwardly from the first and second sidewalls 17, 19 of the holder 13. The forming of ribs 63, 65 integrally from the sidewalls 17, 19 of the holder 13 contributes to the simplicity and low cost of the present invention.

The first and second grooves 67, 69 are formed respectively in the first and second sidewalls 55, 57 of the brush 33 and extend in the first direction 23. The grooves 67, 69 extend from the inner end 51 of the brush 33 toward the outer end 53 of the brush 33 and slidably receive the ribs 63, 65 for guiding movement of the brush 33 in the cavity 21 of the holder 13 as the brush 33 wears. The grooves 67, 69 are preferably arcuate in cross section to mate with the ribs 63, 65 of the holder 13. Other cross sectional shapes of the guides and grooves 67, 69 can also be used. To reduce friction, the mating surfaces of the guides and grooves 67, 69 should have the same shape. A significant feature of the invention is that the grooves 67, 69 and end walls 70, 72 are formed integrally in the carbon brush body. The elimination of additional parts to perform the guiding and stop ping functions of the brush 33 in the holder 13 increases the reliability and reduces the manufacturing cost.

Alternatively, the stop 61 may be formed by a single pair of mating grooves 67, 69 and ribs 63, 65 in lieu of the two pairs of mating grooves 67, 69 and ribs 63, 65. Also, the piloting of the brush 33 in the holder 13 can be formed by a projection formed in the sidewall of the brush 33 and slidably engaged in a slot 29 in the holder 13. Neither of these alternatives is shown.

According to the invention as shown in FIGS. 1, 2 and 7–9, the assembly 11 further comprises the electrically conductive arm 31 for biasing the brush 33 toward the inner end 25 of the cavity 21. The arm 31 is pivotally mounted on the support, extends through the slot 29 of the holder 13 and is engaged with the outer end 53 of the brush 33. Most significantly, the arm 31 applies a bias to the brush 33 when the stop 61 is in an engaged position. In the preferred embodiment, the distal end 60 of the arm 31 is spaced outwardly of the end wall 37 of the slot 29 to apply a bias to the brush 33 when the groove end walls 70, 72 are engaged with the ribs 63, 65 to prevent further inward movement of the brush 33. Thus when the stop 61 is engaged corresponding to the end of the usable brush length, the remainder of the brush 33 is firmly held between the arm 31 and the ribs 63, 65 of the holder 13. This prevents the brush 33 from vibrating and arcing at the end of brush life thus protecting the brush assembly from degradation.

Preferably, the arm 31 further has a base formed by first and second legs 71, 73. Each leg 71, 73 has angularly spaced sidewalls 75, 77 located adjacent opposed sides 81, 83 of the post 49 and pivotal about the post 49 through the angle formed between the angularly spaced sidewalls 75, 77. The arm 31 is pivotal on a sharp edge 79 of the post 49 to provide a low friction pivot. The arm 31 is not connected to the post 49 except through a spring 85 as will be explained below.

The arm 31 serves a number of purposes. First, the arm 31 retains the brush 33 in engagement with the commutator 35. Second, the arm 31 provides an electrical current path between the brush 33 and the motor stators through the post 49 integrally formed on plate 39. This path is supplemented by the current path between the brush 33 and the holder 13. The arm/brush current path is particularly important, for example, when a commutator 35 is worn and causes the brush 33 to vibrate reducing the effectiveness of the brush/ holder current path. The use of parallel current paths and the avoidance of power losses are important in cordless power tools to extend the usable energy from a single charge of the battery pack. Third, the arm 31 thermally insulates the spring 85 from the brush 33. Excessive heat will anneal the spring 85 and damage its spring constant. Arm 31 acts as a heat sink and heat radiator. Heat is eliminated from arm 31 by being supported in the air flow generated by a motor fan (not shown). Finally, the arm 31 provides an inertial load on the brush 33 to make the brush 33 less subject to vibration and arcing.

Figure 9:
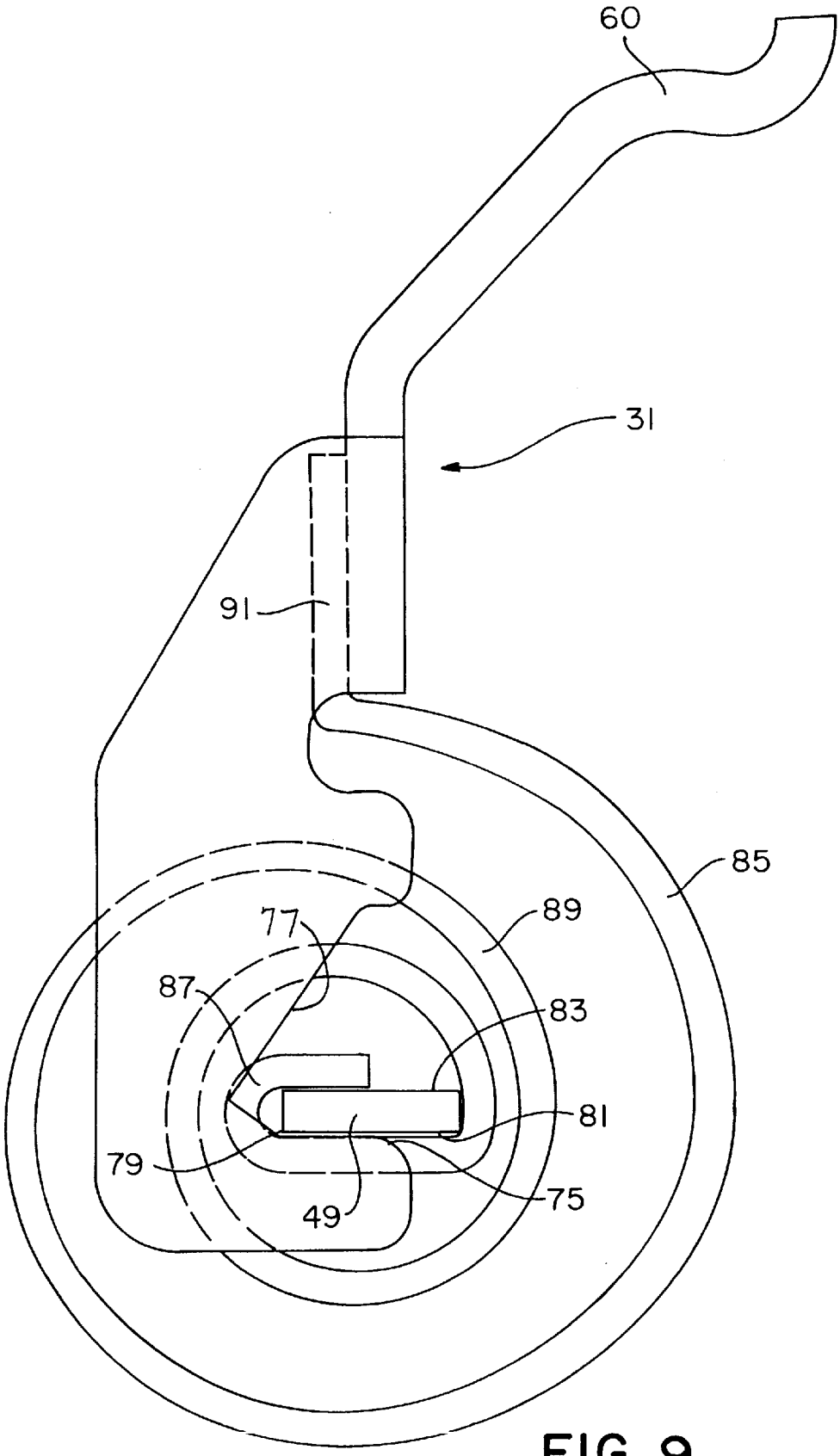
FIG. 9 is a top plan fragmentary view of the arm, spring and post of the brush assembly of FIG. 1. The arm, spring and post are shown in the Position A corresponding to when an unworn brush is in the brush holder.

According the invention as shown in FIGS. 1 and 9, the assembly 11 further comprises a spring 85 connected between the support and the arm 31 for biasing the arm 31 into engagement with the brush 33. Preferably the spring 85 is a clock spring 85 to apply an approximately constant bias to the brush 33 through the full range of motion of the arm 31. A clock spring 85 with a low spring constant is particularly suited for this application. The clock spring 85 has one end 87 connected to the post 49, an intermediate section 89 encircled a number of times about the post 49 and a second end 91 connected to a central portion of the arm 31 for biasing the arm 31 tightly against the post 49 and toward the brush 33. (In FIG. 1, for clarity the intermediate section 89 of the spring 85 is largely omitted. The intermediate section 89 of the spring 85 has nine turns but in FIG. 9 is shown with a reduced number of turns for clarity.) As can be seen in FIG. 1, the travel of arm 31 between positions A and B is a small percentage of the travel of spring 85 required to wrap the spring 85 about post 49 resulting in an approximately constant bias on the brush 33 throughout the life of the brush 33. Tight engagement between the arm 31 and the post 49 is important to insure that good electrical contact is made. Alternatively, the spring 85 can be a coil spring or a torsion spring 85 connected between the support and the arm 31 and biasing the arm 31 into engagement with the brush 33.

In operation, when a brush 33 is unworn the arm 31 is located in position A and biases the brush 33 in contact with the commutator 35. In this position the ribs 63, 65 in the holder 13 are located in the inner end of the grooves 67, 69 corresponding to the stop 61 being located in the disengaged position. As the brush 33 is worn by engagement with commutator 35 during operation of the motor, the brush 33 becomes progressively shorter and continues to move toward the commutator 35 due to the bias applied by the arm 31. Such movement continues until the ribs 63, 65 of the holder 13 engage the end walls 70, 72 of the grooves 67, 69 corresponding to the stop 61 engaged position. With the stop 61 engaged, the arm 31 is located in position B and travel of the brush 33 through the inner end 25 of the holder 13 is no longer possible. In position B, the arm 31 is located outwardly from inner end of the slot 29. As a result the brush 33 is firmly held between the arm 31 and the ribs 63, 65 of the holder 13.

One aspect of the present invention is that it has been discovered in the development of shuntless brush assemblies with an electrically conductive bias arm 31 that degradation of the commutator 35 and the arm 31 at the end of brush life can be significantly reduced. The degradation is believed to have been caused by vibration and looseness of the brush 33 at the end of brush life. The looseness occurred because the arm 31 engaged the slot 29 in the sidewall of the brush holder 13 and was limited in travel by engagement of the arm 31 with the end wall 37 of the slot 29. As the brush 33 continued to wear the arm 31 was no longer able to bias the brush 33 tightly against the commutator 35. Thus the brush 33 may have been subject to vibration and arcing between the brush 33 and arm 31 and between the brush 33 and commutator 35. Thus one significant advantage of the present invention is that the brush 33 is held tightly between the arm 31 and the ribs 63, 65 of the holder 13 when the brush 33 is worn out. As a result damage to the arm 31 and commutator 35 is reduced. If no specific means for identifying when the brush 33 is worn out, operation of the motor will cease when electrical contact between the brush 33 and commutator 35 is no longer possible. The worn brush 33 is then replaced by a new brush 33. Because the worn brush 33 is replaced with less damage being incurred by the motor, life of the motor is increased.

Also there are other advantages result from the present invention. When using a shuntless brush according to the preferred embodiment the assembly 11 provides a low manufacturing cost, lower operating temperature and improved reliability.

Various modifications and variations can be made in a brush assembly according to the present invention without departing from the scope or spirit of the invention. Thus, the present invention is intended to cover these modifications and variations provided they come within the scope of the appending claims and their equivalents.

What is claimed is:

1. A brush holder assembly comprising:

a support;

a tubular holder, fixed to the support, comprising:

a first and second sidewalls extending a first direction and having a slot formed in the first sidewall, the slot having an inner end; and a cavity extending in a first direction, defined by the sidewalls of the holder and having an inner and outer open ends;

a brush slidably mounted in the cavity of the holder;

a stop formed between the brush and the holder, having a disengaged position to permit travel of the brush partially through the inner end of the holder and having an engaged position to limit travel of the brush through the inner end of the holder;

an electrically conductive arm (1) pivotally mounted on the support, (2) extending through the slot of the holder, (3) engageable directly electrically with the outer end of the brush to provide direct electrical physical contact between the arm and the brush, (4) biasing the brush toward the inner end of the cavity and (5) spaced outwardly of the end of the slot to apply a bias to the brush when the stop is in an engaged position; and a spring connected between the support and the arm for biasing the arm directly electrically into contact engagement with the brush.

2. The assembly of claim 1 wherein:

a post extends from the support, and the spring is clock spring, has one end connected to the post, has an intermediate section encircled about the post and has a second end connected to the arm for biasing the arm toward the brush.

3. The assembly of claim 2 wherein the post has opposed sides and the arm further comprises a base with angularly spaced sidewalls, defining an angle formed therebetween, located adjacent the sides of the post; and the arm is pivotal about the post through the angle formed between the angularly spaced sidewalls.

4. The assembly of claim 1 wherein:

the stop is formed by first and second ribs on the holder and first and second mating grooves formed on the brush;

the ribs are formed on the first and second sidewalls of the holder;

the brush is formed with first and second sidewalls and an inner end;

the grooves are formed on the first and second sidewalls of the brush, extend from the inner end of the brush toward the outer end of the brush, and slidably receive the first and second ribs for guiding movement of the brush in the cavity of the holder as the brush wears.

5. The assembly of claim 1 wherein the brush is shuntless.

6. A brush holder assembly comprising:

a support;

a tubular holder, fixed to the support, comprising:

a first and second sidewalls extending a first direction and having a slot formed in the first sidewall, the slot having an inner end; and a cavity extending in a first direction, defined by the sidewalls of the holder and having an inner and outer open ends;

a brush slidably mounted in the cavity of the holder;

a stop formed between the brush and the holder, having a disengaged position to permit travel of the brush partially through the inner end of the holder and having an engaged position to limit travel of the brush through the inner end of the holder;

an electrically conductive arm (1) pivotally mounted on the support, (2) extending through the slot of the holder, (3) engageable with the outer end of the brush, (4) biasing the brush toward the inner end of the cavity and (5) spaced outwardly of the end of the slot to apply a bias to the brush when the stop is in an engaged position;

a spring connected between the support and the arm for biasing the arm into engagement with the brush;

a post having opposed sides extends from the support;

the arm is formed with a base having angularly spaced sidewalls, defining an angle formed therebetween, located adjacent the sides of the post;

the arm is pivotal about the post through the angle formed between the angularly spaced sidewalls; and the spring is a clock spring having one end connected to the post, an intermediate section encircled about the post and has a second end connected to the arm for biasing the arm toward the brush.

7. A brush holder assembly comprising:

a support;

a tubular holder, fixed to the support, comprising:

a first and second sidewalls extending a first direction and having a slot formed in the first sidewall, the slot having an inner end; and a cavity extending in a first direction, defined by the sidewalls of the holder and having an inner and outer open ends;

a brush slidably mounted in the cavity of the holder;

a stop formed between the brush and the holder, having a disengaged position to permit travel of the brush partially through the inner end of the holder and having an engaged position to limit travel of the brush through the inner end of the holder;

an electrically conductive arm (1) pivotally mounted on the support, (2) extending through the slot of the holder, (3) engageable with the outer end of the brush, (4) biasing the brush toward the inner end of the cavity and (5) spaced outwardly of the end of the slot to apply a bias to the brush when the stop is in an engaged position;

a spring connected between the support and the arm for biasing the arm into engagement with the brush;

a post having opposed sides extends from the support; and the arm is formed with a base having angularly spaced sidewalls located adjacent the sides of the post.

8. The assembly of claim 7 wherein:

the arm is pivotal about the post through the angle formed between the angularly spaced sidewalls.

* * * * *